US007491160B2

(12) United States Patent
Vestola et al.

(10) Patent No.: US 7,491,160 B2
(45) Date of Patent: Feb. 17, 2009

(54) GROOVED FORMING ROLL

(75) Inventors: Juhani Vestola, Jyväskylä (FI); Heikki Karttunen, Jyväskylä (FI)

(73) Assignee: Metso Paper, Inc., Helsinki (FI)

( * ) Notice: Subject to any disclaimer, the term of this patent is extended or adjusted under 35 U.S.C. 154(b) by 835 days.

(21) Appl. No.: 11/054,120

(22) Filed: Feb. 9, 2005

(65) Prior Publication Data

US 2005/0176566 A1 Aug. 11, 2005

(30) Foreign Application Priority Data

Feb. 10, 2004 (FI) ..... 20045033
Mar. 25, 2004 (FI) ..... 20045102

(51) Int. Cl.
*A01B 29/00* (2006.01)

(52) U.S. Cl. ..... 492/30; 492/28; 492/31; 492/33; 492/34; 492/36; 492/48

(58) Field of Classification Search ..... 492/30, 492/31, 33, 34, 36, 48, 28
See application file for complete search history.

(56) References Cited

U.S. PATENT DOCUMENTS

| | | | | |
|---|---|---|---|---|
| 1,805,780 | A * | 5/1931 | Millspaugh | 162/372 |
| 2,566,439 | A * | 9/1951 | Beachler | 492/31 |
| 2,753,181 | A * | 7/1956 | Anander | 226/95 |
| 2,803,188 | A * | 8/1957 | Duvall | 101/32 |
| 4,207,998 | A * | 6/1980 | Schmid | 226/95 |
| 5,383,778 | A * | 1/1995 | Schulz | 425/363 |
| 5,490,902 | A * | 2/1996 | Schulz | 162/109 |
| 5,529,100 | A * | 6/1996 | Koba | 144/2.1 |
| 6,030,503 | A * | 2/2000 | Matuschczyk | 162/358.4 |
| 6,106,447 | A * | 8/2000 | Schiel | 492/48 |
| 7,326,322 | B2 * | 2/2008 | Ruthven et al. | 162/362 |
| 2006/0185533 | A1 * | 8/2006 | Saueressig | 101/22 |

FOREIGN PATENT DOCUMENTS

| | | |
|---|---|---|
| DE | 102 27 846 A1 | 1/2004 |
| DE | 102 27 847 A1 | 1/2004 |
| EP | 1 375 743 A1 | 1/2004 |
| FI | 111861 B | 9/2003 |
| WO | WO 99/32713 B | 1/1999 |

* cited by examiner

*Primary Examiner*—Essama Omgba
(74) *Attorney, Agent, or Firm*—Stiennon & Stiennon

(57) ABSTRACT

A grooved forming roll in a paper machine has a rotably supported shell (20) with circular openings (21) arranged to be open at least on the outer surface of the shell (20). Each opening (21) has a circular groove which is formed on the outer surface and which is arranged concentrically relative to the opening (21). A portion of the formed circular openings (22) extends to each opening (21) from each adjacent opening (21). The outer radius (r) of the circular groove (22) is arranged such that the number of necks (24), delimited by the adjacent openings (21) and their circular grooves (22) on the shell outer surface within the area of one circular groove (22), is greater than the number of the adjacent openings (21) of the corresponding opening (21).

21 Claims, 7 Drawing Sheets

| N / kpl | m / mm | B / mm | s / mm | D / kpl/dm² |
|---|---|---|---|---|
| 14 | 71,424 | 123,71 | 27,0 | 16 |
| 26 | 71,424 | 123,71 | 19,8 | 29 |
| 38 | 71,424 | 123,71 | 16,4 | 43 |
| 14 | 71,424 | 41,24 | 15,6 | 48 |
| 28 | 71,424 | 82,47 | 15,6 | 48 |
| 28 | 71,424 | 61,85 | 13,5 | 63 |
| 14 | 35,712 | 61,85 | 13,5 | 63 |
| 26 | 71,424 | 41,24 | 11,4 | 88 |
| 26 | 35,712 | 61,85 | 9,9 | 118 |
| 38 | 71,424 | 123,71 | 9,5 | 129 |
| 38 | 35,712 | 61,85 | 8,2 | 172 |
| 14 | 35,712 | 20,62 | 7,8 | 190 |
| 28 | 35,712 | 41,24 | 7,8 | 190 |
| 28 | 35,712 | 30,93 | 6,7 | 254 |
| 17 | 35,712 | 17,07 | 6,4 | 279 |
| 26 | 35,712 | 20,62 | 5,7 | 353 |
| 30 | 35,712 | 17,86 | 5,0 | 470 |
| 38 | 35,712 | 20,62 | 4,7 | 516 |
| 11 | 35,712 | 27,26 | 10,1 | 113 |

Fig. 6

GROOVED FORMING ROLL

This application claims priority on Finnish Application No. 20045033, Filed Feb. 10, 2004, and Finnish Application No. 20045102, Filed Mar. 25, 2004.

STATEMENT AS TO RIGHTS TO INVENTION MADE UNDER FEDERALLY SPONSORED RESEARCH AND DEVELOPMENT

Not applicable.

BACKGROUND OF THE INVENTION

The invention relates to a grooved forming roll, which includes a rotably supported shell comprising circular openings arranged to be opened at least on the outer surface of the shell, and associated with each opening, a circular groove formed on the outer surface, arranged concentrically relative to the corresponding opening, and on which outer surface a portion of the formed circular grooves extends to each opening from each adjacent opening.

WO publication No. 9932713 discloses a forming roll and particularly the design of its outer surface. The object has been to increase the open surface of the shell for avoiding the previously used wire net. Previously, a plastic wire net was placed on top of the forming roll by shrinking, which wire net wore out fast during use. Another problem has been curling and soiling of the expensive wire net. The wire net has also set restrictions on the use of cleaning chemicals and high pressure cleaning. However, a drilled shell without a wire net would make clear marking in the web due to the effect of vacuum and/or the outer fabric during web forming. As a solution for the problem the publication proposes spiral grooves machined obliquely in relation to each other with which necks of material between the openings are divided into smaller parts. In this way, a flow connection is created between each two adjacent openings.

Machining of spiral grooves is a demanding procedure, in which special tools are required. In addition, despite of setting, the necks become indefinite in form and size. This makes the grooved outer surface of the shell sensitive to damaging and the sharp forms deplete the fabric. Furthermore, the proposed forming roll has operated in the desired way with some furnish grades only. The said publication also proposes the use of circular grooves in creating the grooving. Compared to spiral grooves, irrespective of easier machining, the remaining necks are large and the flow between the adjacent openings is poor. In this situation the marking problem remains as the flow speed of water varies in different positions of the forming roll.

SUMMARY OF THE INVENTION

The object of the invention is to provide a new type of grooved forming roll, which avoids web marking and is more resistant than heretofore. In the forming roll according to the invention, circular grooves are used for creating flow connections between the openings. With suitable positioning and dimensioning of the circular grooves, uniform grooving can be achieved in the necks between the openings. At the same time, a large open surface area can be provided for the roll while the remaining necks are either small or narrow. Thus the flow of water can be made as uniform as possible in various positions. In practice, due to the large open surface area and narrow necks, water is removed mainly in the roll radial direction while the flow in the web direction is small. Consequently, dewatering is uniform in the entire roll area and the marking problem is avoided. In addition, a grooving according to the invention is easy to modify to suit various applications.

The invention is described below in detail by making reference to the accompanying drawings illustrating some of the embodiments of the invention.

BRIEF DESCRIPTION OF THE DRAWINGS

FIG. 6 is a table of the perforation patterns according to the invention.

DESCRIPTION OF THE PREFERRED EMBODIMENTS

Figure 1:
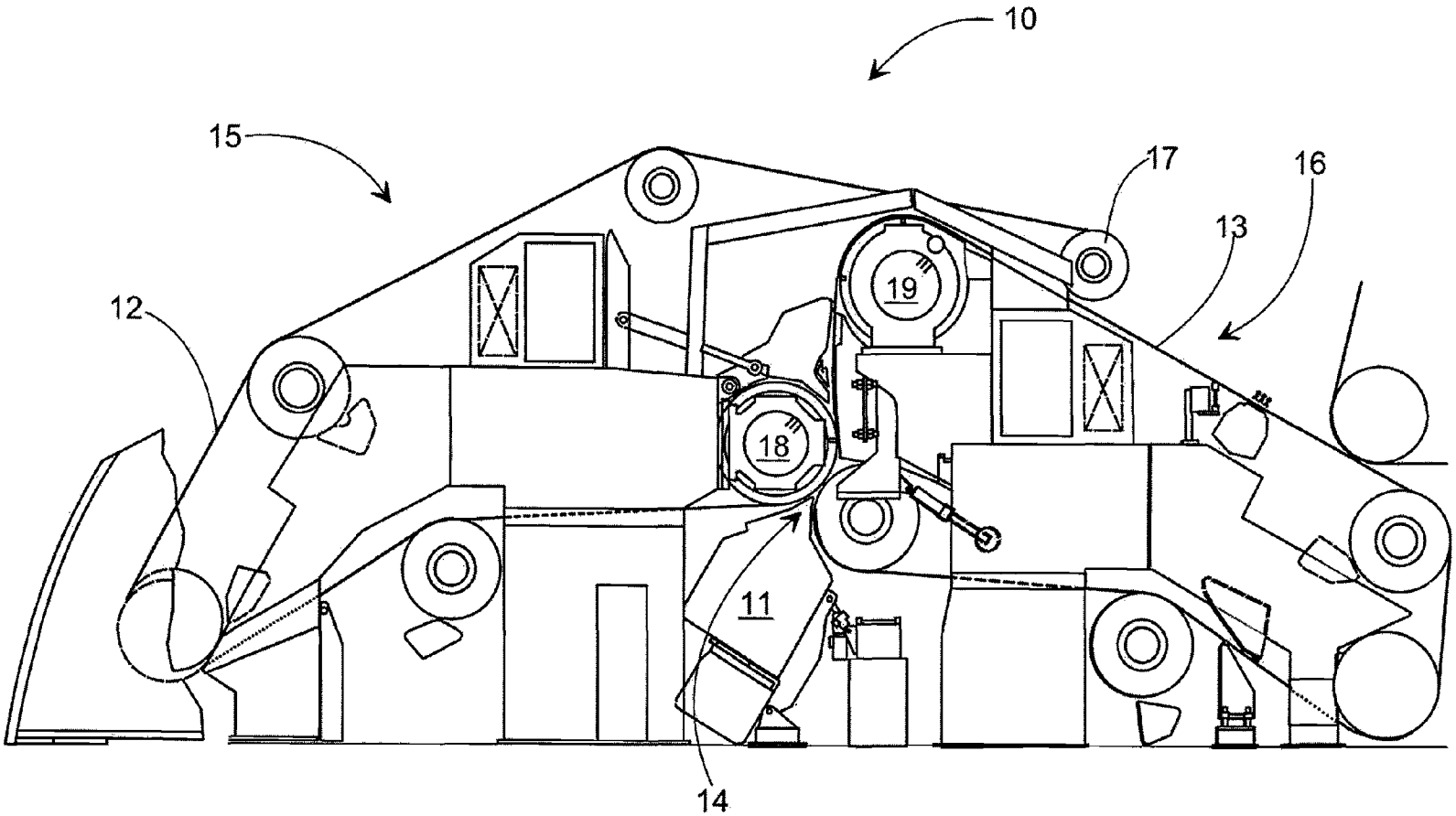
Fig. 1 Prior Art
FIG. 1 is a side view of a forming section of a known former.

FIG. 1 shows a forming section 10 of a paper machine known as such. Here the forming section 10 is arranged as a gap former in which the stock suspension is supplied from the headbox 11 to a gap 14 formed by two fabrics 12 and 13. The fabrics 12 and 13 form two closed fabric loops which are supported in the forming section 10 by roll assemblies 15 and 16 arranged for them. In practice the fabrics 12 and 13 travel a portion of the distance essentially in close contact with each other with the web remaining between them. This portion of a distance starts from the gap 14 and ends at the fabric 12, at its return roll 17, which is supported above the inner fabric 13. The roll assembly 15 of the outer fabric 12 also comprises a forming roll 18, which is shared between both the roll assemblies 15 and 16 from the gap 14 onwards. The forming roll 18 is also called the first couch roll. The second couch roll 19 is also shared between both the roll assemblies 15 and 16.

Figure 2A:
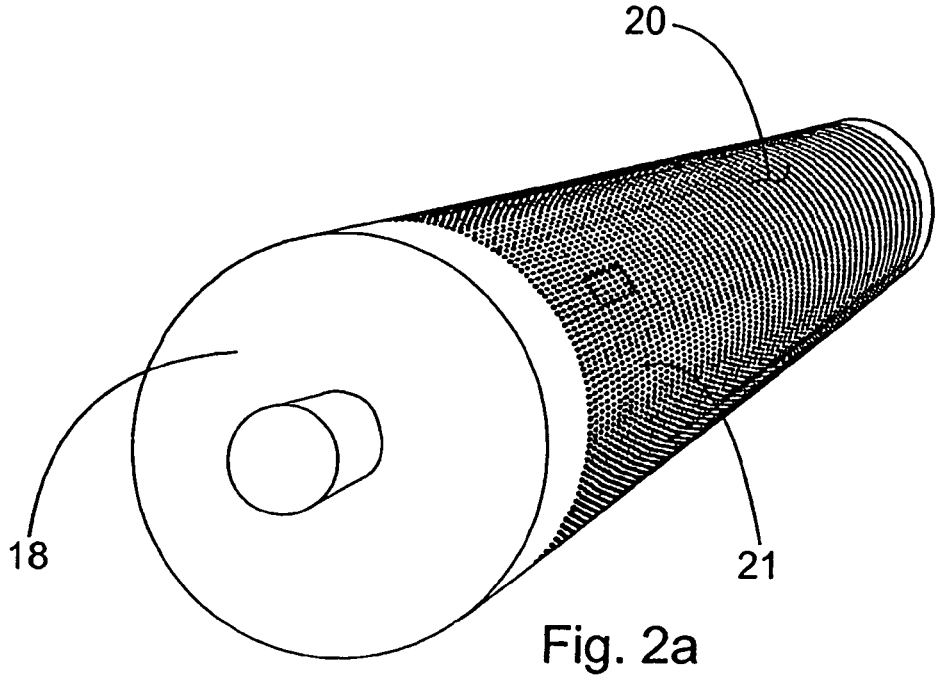
FIG. 2*a* is a perspective view of the forming roll according to the invention.
Figure 2B:
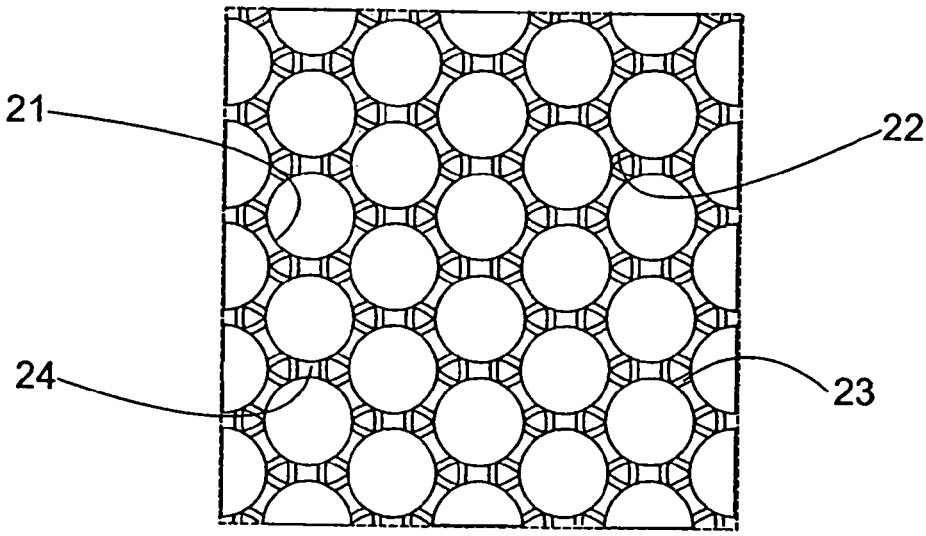
FIG. 2*b* shows a part of the shell outer surface of a forming roll according to the invention.

The forming roll according to the invention is indicated for use in the forming section, where marking is the most serious problem. A recently formed web contains a lot of water. At least the above-mentioned first couch roll is a forming roll 18 according to the invention, and is later referred to simply as "roll". The roll according to the invention can also be used as the second couch roll. FIG. 2*a* shows one roll 18 provided with a grooving according to the invention, comprising a rotably supported shell 20. FIG. 2*b* illustrates a similar roll surface and grooving. The shell 20 has circular openings 21 arranged to be opened on its outer surface. Here the openings are through holes from which the negative pressure to be created inside the roll can act on the web through the fabric.

For creating the negative pressure, the roll has usually an internal suction box, with which the negative pressure can be restricted to a certain section of the roll (not shown). Alternatively, it is possible to refrain from using the vacuum or even leave out the roll internal suction box and vacuum connections. In this case the outer fabric, due to its tension, presses the water to the roll's openings in the same way as a vacuum. In addition, associated with each opening, formed on the outer surface there is a circular groove, which is arranged concentrically in relation to the corresponding opening. The design of the openings and circular grooves is described in more detail in connection with FIGS. 3*a*-5*b*. Circular grooves are additionally so arranged that on the outer surface of the roll a portion of the formed circular grooves extends to each opening from each adjacent opening. The portion of the circular groove thus forms a flow connection between two adjacent openings.

Figure 3A:
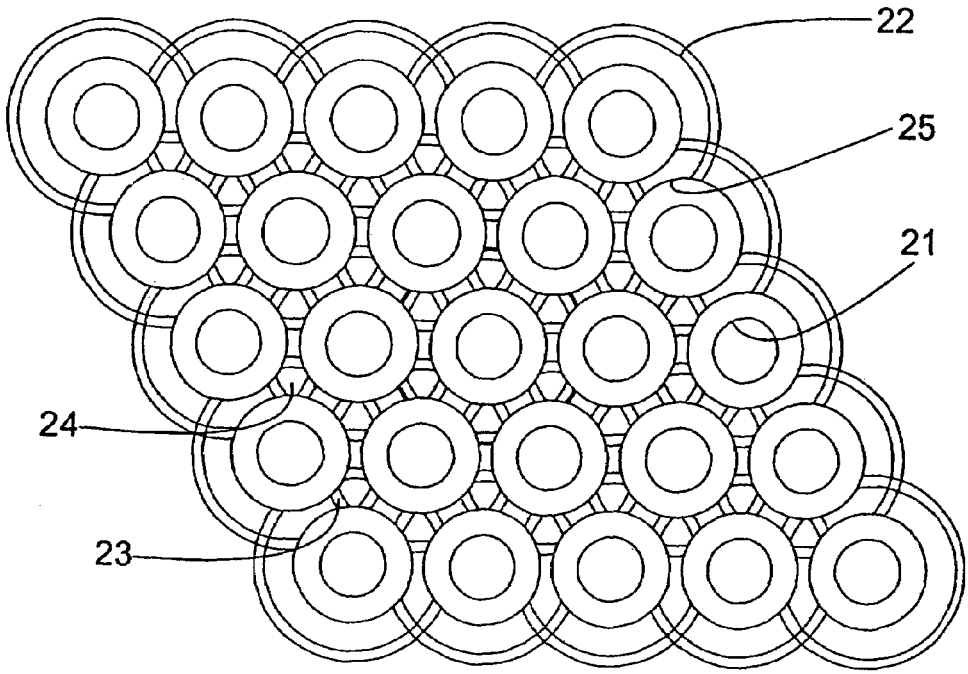
FIG. 3*a* shows an embodiment of the grooving according to FIG. 2*b*.
Figure 3B:
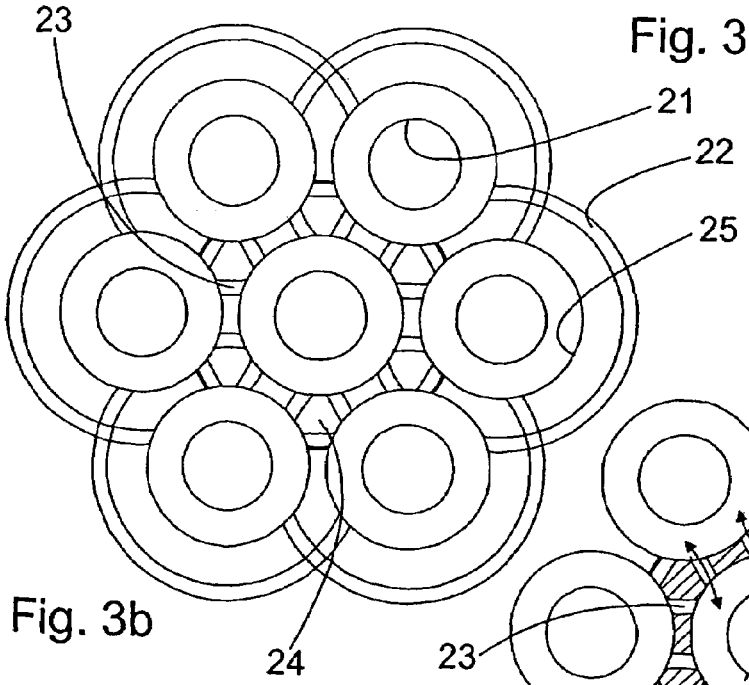
FIG. 3*b* shows the circular grooves associated with one opening of FIG. 3*a*.
Figure 3C:
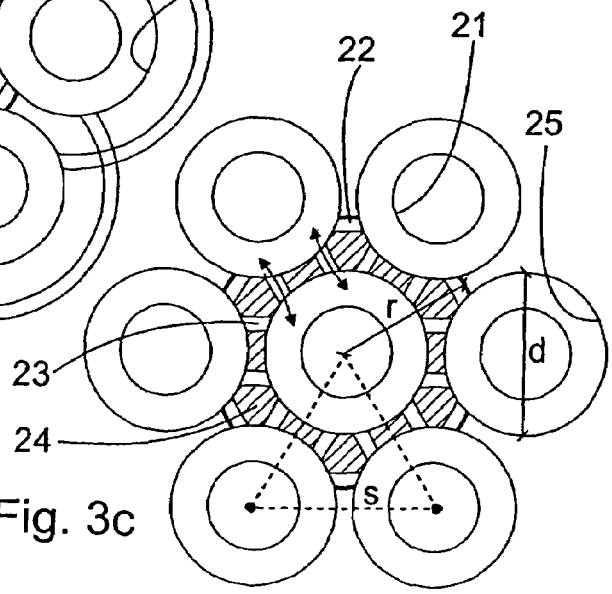
FIG. 3*c* shows the necks delimited by the circular groove of one opening of FIG. 3*b*.

A preferably large open surface area and a smooth and uniform water flow are achieved by splitting the necks between the openings. According to the invention, the outer radius of the circular groove is arranged such that the number of necks, delimited by the adjacent openings and their circular grooves on the shell outer surface within the area of one circular groove, is greater than the number of the adjacent openings of the corresponding opening. For illustrating this feature, FIG. 3*c* shows the circular grooves 22 associated with one opening and the necks 24 formed by them. In FIG. 3*c* the necks 24 are shown with a shading. In this embodiment the outer radius r of the circular groove is smaller than the distance s between the centers of two adjacent openings, but greater than half the distance s between the said centers of two adjacent openings, i.e. $s/2<r<s$. Consequently, the necks become relatively identical in size and lack sharp edges. Here the number of necks is twelve, whereas the number of adjacent openings in the reference opening is six. Likewise, FIG. 3*b* shows the circular grooves 22 of seven openings 21. This pattern is repeated on the roll surface, whereby a grooving according to FIG. 3*a* is formed. Functionally similar parts are referred to with identical reference numbers. The outer radius of the circular groove is referenced with the letter r in the figures. Correspondingly, the distance between the centers of the openings is referenced with letter s and the diameter of the opening with letter d.

Figure 4A:
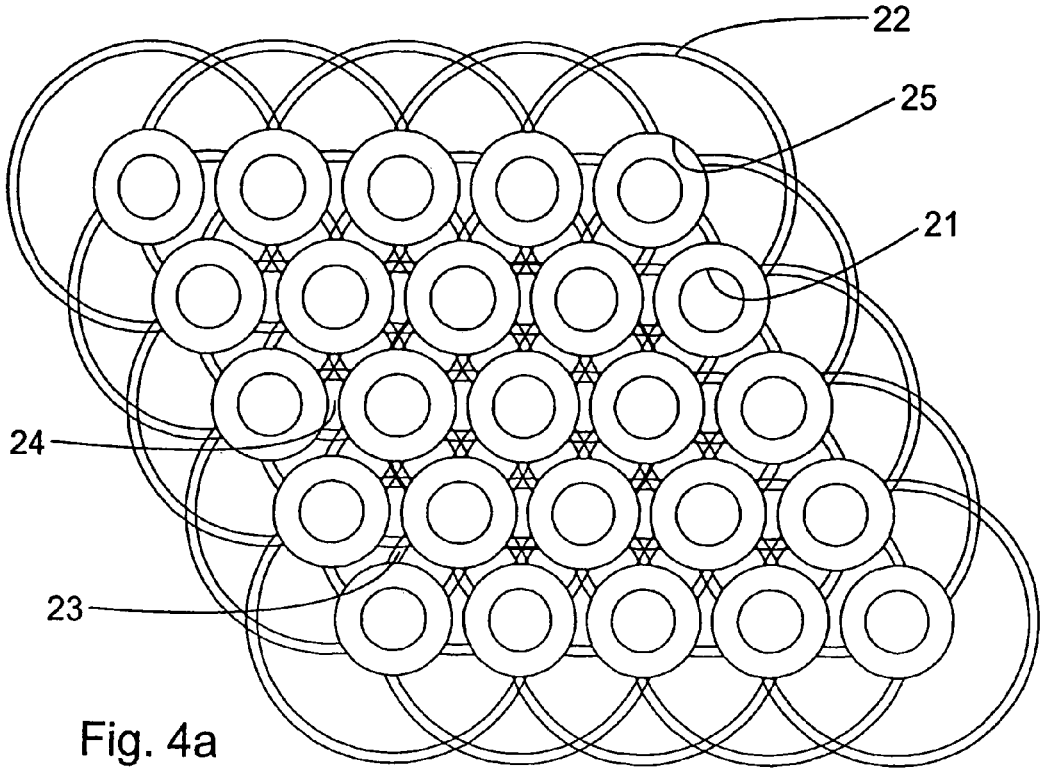
FIG. 4*a* shows another embodiment of the grooving according to the invention.
Figure 4B:
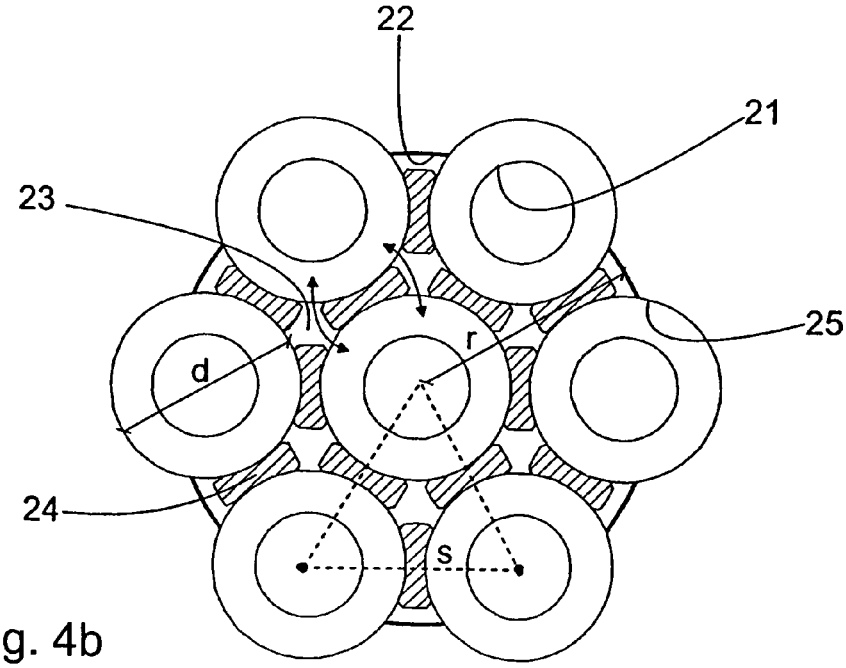
FIG. 4*b* shows the necks delimited by the circular groove of one opening of FIG. 4*a*.
Figure 5A:
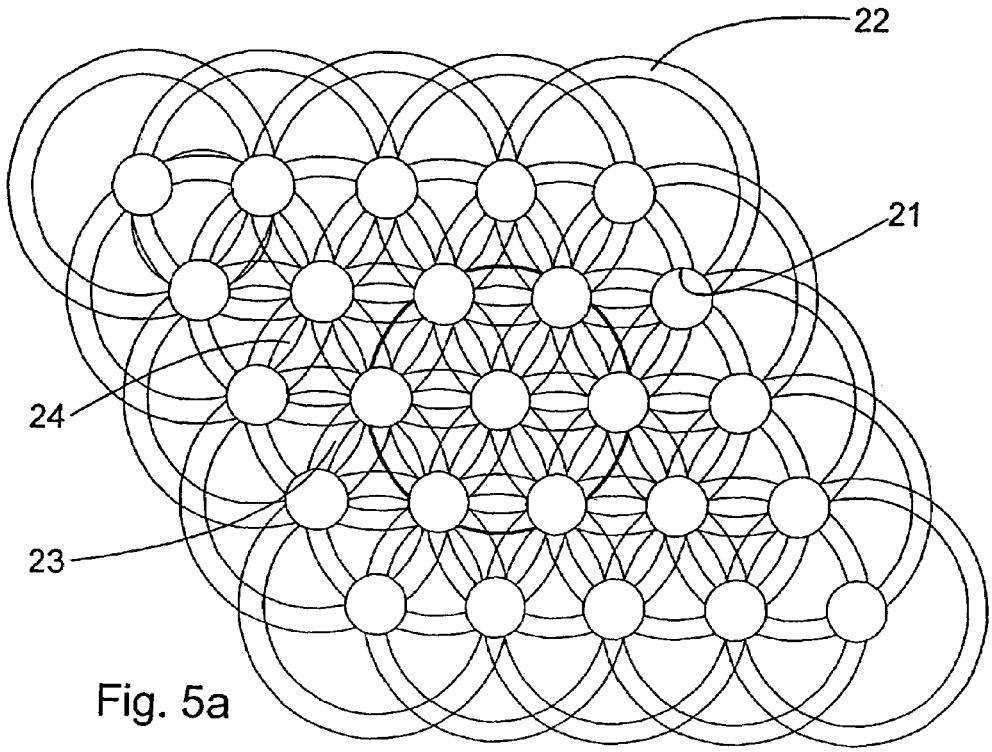
FIG. 5*a* shows a third embodiment of the grooving according to the invention.
Figure 5B:
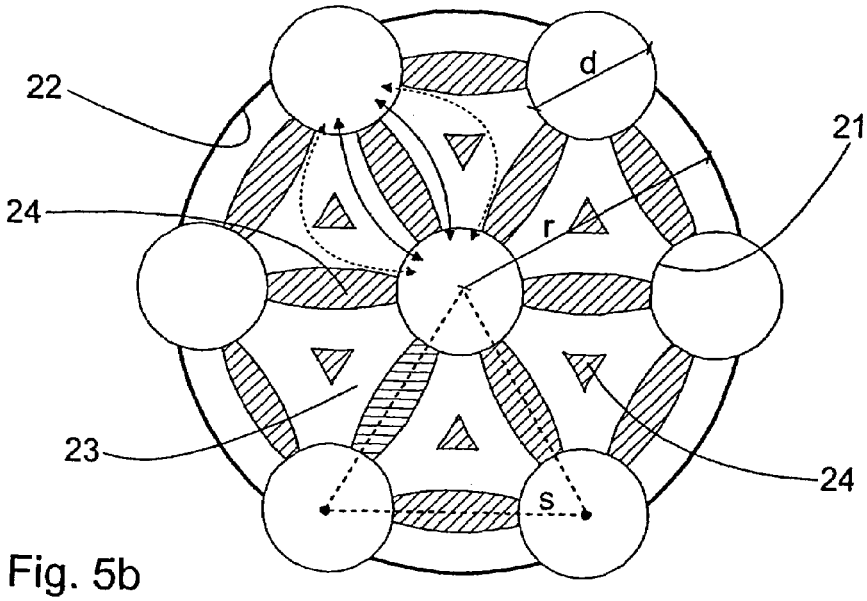
FIG. 5*b* shows the necks delimited by the circular groove of one opening of FIG. 5*a*.

FIGS. 4*a* and 4*b* show another embodiment of the roll according to the invention. Here the outer radius r of the circular groove 22 is greater than the distance s between the centers of two adjacent openings 21, but smaller than or equal to the sum of the distance s between the centers of the said openings 21 and the half of the diameter d of the opening 21, i.e. $s<r\leqq(s+d/2)$. With suitable dimensioning necks can be made elongated and identical in shape in relation to each other. In this embodiment, too, one opening is surrounded by twelve necks. The necks can be made narrower by enlarging further the diameter of the openings, for example. Generally the number of necks in the area delimited by one circular groove is double or triple compared to the number of adjacent grooves. A triple number of necks is achieved by reducing the diameter of the openings, for example, and by increasing correspondingly the diameter of the circular grooves. This type of embodiment is illustrated in FIGS. 5*a* and 5*b*. This embodiment has two types of necks 24, both small and elongated. Particularly here the flow connections 23 are wide and the open surface area in the roll is large.

Figure 7A:
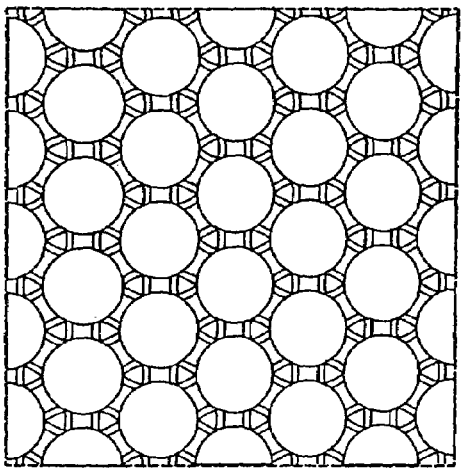
FIGS. 7*a-d* show various surface patterns of a forming roll according to the invention.
Figure 7B:
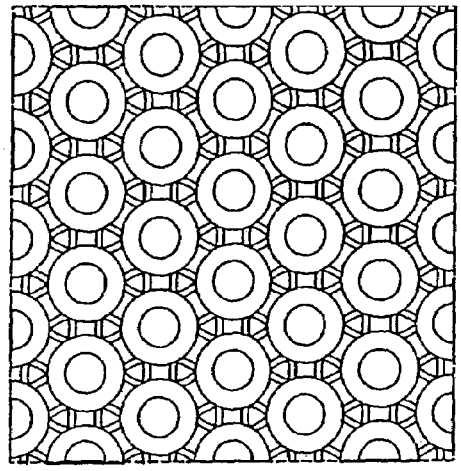
Figure 7C:
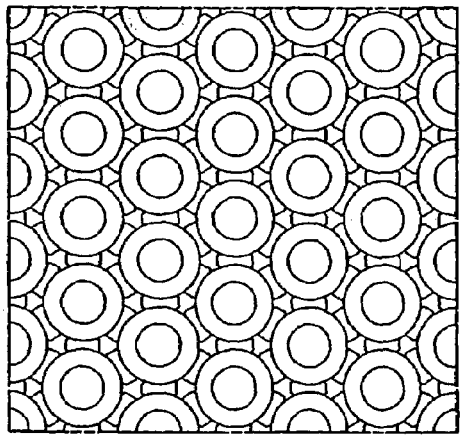
Figure 7D:
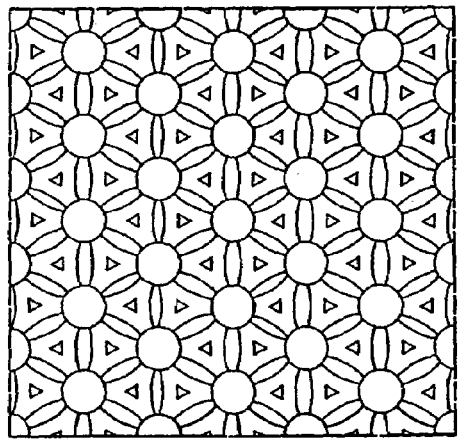

Characteristic of the roll according to the invention is additionally that between two adjacent openings there are at least two flow connections that are formed of parts of the different circular grooves. This design ensures a uniform water flow. In addition, the flow connections are essentially symmetric in relation to each other, whereby it is possible to efficiently avoid speed variations in the water flow between different openings. At the same time, it is possible to minimize dimensional variation of the necks identical in form. In this way, it is possible to maximize the open surface area without any one of the necks being mechanically weaker than the others-are. In FIGS. 3*c*, 4*b* and 5*b* the flows between two-adjacent openings are illustrated with double-headed arrows. A preferably symmetrical pattern is achieved by arranging the openings with an identical diameter and adapting them at an equal distance from each other. This arrangement is also well suitable for the existing machining equipment, and the final pattern becomes symmetrical. FIGS. 7*a*-7*d* show various surface patterns of a forming roll according to the invention. Example patterns are regular and the openings comprising a hole may have a countersink. FIGS. 7*a* and 7*d* have holes only, whereas in FIGS. 7*b* and 7*c* the holes have additionally countersinks, which are preferably arranged concentrically in relation to the corresponding opening. Countersinking can be arranged either in part of the holes or in all of them, as is shown here as example.

In the exemplifying embodiments of FIGS. 3*c* and 4*b* the diameter of the opening is 5 mm and each opening has a countersink 25 with a diameter of 9 mm. In the embodiments of FIGS. 3*c* and 4*b* the openings 21 have circular grooves 22. In FIG. 3*c* the outer diameter of the circular groove 22 is 15 mm and in FIG. 4*b* it is 23 mm respectively. In both embodiments the width of the circular groove is 0.8 mm. In FIG. 5, minimization of the diameter of the openings 21 is aimed at for reducing the disturbing effect caused by them. At the same time, maximization of the width of the circular grooves is aimed at for reducing flow resistances. In this example the diameter of the opening is 5 mm and the outer diameter of the circular groove is 22 mm while the width of the circular groove is 1.6 mm. In all embodiments set forth the centers of the openings are at a distance of 9.9 mm from each other. In this way it is easy to detect the effect of the dimensioning of the opening and the circular groove on the neck size and shape and thus on the portion of the open surface area. Generally the width of the circular groove is 1-25 percent of the radius of the circular groove, however at least 0.5 mm. In the embodiments of FIGS. 3*c* and 4*b* the width of the circular groove is 0.8 mm and it is 1.6 mm in the embodiment of FIG. 5*b*. In practice the depth of the circular groove is arranged greater than its width, whereby the circular groove can take sufficiently water with the necks still remaining resistant. Generally the width of the circular groove is 0.5-2 mm and its depth is 1-25 mm, preferably 1.5-8 times the width of the circular groove. Such circular grooves are also economically advantageous to manufacture. By widening the circular groove, the water flow also improves at the same time as well as the resistance of machining blades. In the roll dimensioning it is possible to use in default an outer radius of the circular groove, which is 1.3-5 times greater than the diameter of the opening.

Circular grooves according to the invention provide an open surface area that is larger and above all more uniformly distributed than heretofore, the portion thereof being more than 70 percent in relation to the roll outer surface. For example, in the embodiment of FIG. 3*c* the portion of the open surface area is approximately 80 percent and in the embodiment of FIG. 4*b* it is as much as 90 percent. In practice, openings and their possible countersinks are machined first in the roll shell. After this, using the same blade distribution and preferably the same machining tool, circular grooves are machined in connection with each opening. Finally, any burrs are removed with shot blasting, for example. The resistance of necks can be further improved by arranging a hard coating on the outer surface of the shell, for example.

For achieving a water flow as uniform as possible, general dimensioning instructions can be used. Minimizing the size of the opening and maximizing a grooving that is as open and homogenous as possible, for example, reduces roll marking. On the other hand, the grooving must be sufficiently open and deep to make the removing water flow as much as possible in the roll radial direction. Individual grooves should also be made smooth, whereby vacuum is uniformly distributed over the entire area. At the same time, soiling of grooves is avoided. The size and shape of the necks also influence the flows. For example, by making the necks as narrow as possible, the roll surface can be made to function as if it would have a wire net. Consequently, marking is avoided. The necks can also be reduced in size by distributing the openings at closer intervals.

A symmetric pattern in which the openings are at an equal distance from each other means in practice an equilateral-triangle pattern. Several restrictions apply in the manufacture of such a pattern on the roll surface. For example, it is necessary to use a so-called spiral pattern. That is, the rows formed by the adjacent openings must not be in the direction of the roll shaft. A spiral shape pattern reduces noise. In addition, the number of the spindle distributions according to the international standard in the drilling machines required in the machining is limited. The most common spindle distribution is 35.712 mm. The table in FIG. 6 shows drilling patterns made using this spindle distribution and its multiple, forming exactly or almost exactly an equilateral triangle. The patterns are arranged according to a growing hole frequency. By making the drilling patterns denser it is possible to shorten the flow distances in the direction of the water surface as well as to reduce the hole size and necks while the open surface area remains the same. With these means it is possible to further reduce the marking tendency. A suitable hole frequency is selected according to the application. In the table of FIG. 6, N is the number of openings in the basic pattern, m is the spindle distribution, B is the height of the basic pattern, s is the distance between the centers of the openings and D is the number of openings.

In the embodiment of FIG. 5*b*, the surface pattern, formed by necks 24 having sizes and shapes that differ from each other, closely resembles a wire net. For example, the width, 1.6 mm, of the circular grooves 22 is of the same order as the mesh size of a known wire net, which is approximately 1.3 mm. Likewise, the width, 0.9 mm, of the elongated neck 24 between the openings 21 is of the same order as the thread thickness of the wire net, which is approximately 0.8 mm. Consequently, the marking tendency of the pattern concerned is slight, as the water can totally enter the roll in the radial direction. In the same application the manufacturing costs of the roll decrease by the lack of countersinking. In addition, through drilling of openings, drilling of circular grooves and a possible burring drilling can be made using the same machining tool and the same settings. At the same time, roll transfers are avoided between the machining stages. When selecting a greater width for the circular grooves than the one set forth above, the small triangular necks can be completely eliminated.

A roll according to the invention is extremely well suitable for use as a forming roll due to its nonexistent marking tendency. In addition, the roll is more economical to manufacture than heretofore and its characteristics can be selected as desired. The roll also has a large open surface area with smooth flow connections. Consequently, the effect of vacuum is uniformly distributed on the entire roll shell area and the water flows mainly in the roll radial direction. In addition, with the roll according to the invention and its grooving, it is possible to avoid unnecessary fabric wear. At the same time, the life of the roll itself becomes long.

We claim:

1. A grooved forming roll, comprising:

a rotatably supported shell having an outer surface;

portions of the rotatably supported shell forming a plurality of circular openings which open at least on to the outer surface of the shell;

each opening defining a plurality of adjacent openings, from the plurality of circular openings;

corresponding with each opening, portions of the rotatably supported shell forming a circular groove recessed from the outer surface, each circular groove arranged concentrically relative to the corresponding opening, and each circular groove defining an outer radius;

wherein a portion of one of said formed circular grooves extends to each opening from each adjacent opening;

wherein the outer radius of the circular grooves is selected such that a number of necks of material formed of the shell and forming part of the outer surface of said shell lie within the area of one circular groove, which necks are delimited by the adjacent openings and their corresponding circular grooves; and wherein the number of necks is greater than the number of adjacent openings of the corresponding opening.

2. The forming roll of claim 1, wherein the outer radius of each circular groove is smaller than a distance defined between centers of adjacent openings, but greater than one half of said defined distance.

3. The forming roll of claim 1, wherein the outer radius of each circular groove is greater than a defined distance between centers of two adjacent openings, but smaller than or equal to the sum of the defined distance plus one half of a diameter of one of said adjacent openings.

4. The forming roll of claim 1, wherein the number of necks within the area delimited by one circular groove is selected from the group consisting of: double and triple, compared to the number of adjacent openings.

5. The forming roll of claim 1, wherein between each two adjacent openings there are at least two flow connections that are formed by parts of each of two different circular grooves.

6. The forming roll of claim 5, wherein the flow connections are essentially symmetrical with each other.

7. The forming roll of claim 1, wherein each opening of the plurality of openings is identical in diameter and arranged at an equal distance from each adjacent opening.

8. The forming roll of claim 1, wherein each opening comprises a hole through the rotatably supported shell.

9. The forming roll of claim 8, wherein at least a portion of the plurality of openings comprises a countersink and a corresponding hole.

10. The forming roll of claim 9 wherein the countersink is arranged concentrically in relation to the corresponding hole.

11. The forming roll of claim 8, wherein all the openings of the plurality of openings comprise a hole and a countersink.

12. The forming roll of claim 1, wherein each circular groove has a width which is 10-25 percent of the outer radius of the circular groove and being at least 0.5 mm.

13. The forming roll of claim 1, wherein the outer radius of the corresponding circular groove is 1.3-5 times a diameter defined by each opening.

14. The forming roll of claim 1, wherein each circular groove has a width and each circular groove defines a depth which is greater than its width.

15. The forming roll of claim 14, wherein the depth of each circular groove is 1-25 mm and 1.5 to 8 times the width of each circular groove.

16. The forming roll of claim 1 wherein each circular groove has a width which is 0.5 mm to 2 mm.

17. The forming roll of claim 1, wherein the outer surface of the shell is provided with a hard coating.

18. A grooved forming roll in a paper machine, comprising:

a rotatably supported shell having an outer surface;

portions of the rotatably supported shell forming a plurality of circular openings which open at least on to the outer surface of the shell;

wherein a plurality of said plurality of circular openings comprises a defined number of adjacent openings around a selected opening;

portions of the rotatably supported shell which form a circular groove corresponding with each opening and recessed from the outer surface, each circular groove being arranged concentrically relative to the corresponding opening, and each circular groove defining an outer radius;

wherein a portion of each of said circular grooves corresponding to the adjacent openings extends to the selected opening;

wherein portions of the shell define a number of necks of material which comprise a part of the outer surface of said shell, the necks being positioned within the area of the circular groove corresponding to the selected opening, wherein the necks are delimited by the adjacent openings and their corresponding circular grooves; and wherein the outer radius of each circular groove is selected such that the number of necks within the area of the circular groove corresponding to the selected opening, is greater than the number of defined adjacent openings.

19. A grooved forming roll, comprising:

a rotatably supported shell having an outer surface;

portions of the rotatably supported shell forming a plurality of circular openings which open at least on to the outer surface of the shell;

each opening, of the plurality of circular openings, defining six adjacent openings, from the plurality of circular openings;

corresponding with each opening, portions of the rotatably supported shell forming a circular groove recessed from the outer surface, to form a plurality of circular grooves, each circular groove arranged concentrically relative to the corresponding opening, and each circular groove defining an outer radius;

wherein a portion of one of said plurality of circular grooves, extends to each opening from each of said six adjacent openings;

wherein the outer radius of each circular groove is selected such that a number of necks of material formed of the shell and forming part of the outer surface of said shell lie within the area of each circular groove, which necks are delimited by the adjacent openings and their corresponding circular grooves; and wherein the number of necks is greater than six.

20. The forming roll of claim 19, wherein each opening of the plurality of openings is identical in diameter and arranged at an equal distance from each adjacent opening.

21. A grooved forming roll in a paper machine, the forming roll comprising:

a shell rotatably supported in a forming section of the paper machine, and having an outer surface;

portions of the rotatably supported shell forming a plurality of circular openings with concentric grooves of a selected radius, which circular openings and concentric grooves open at least on to the outer surface of the shell;

each opening of the plurality of circular openings defining six adjacent openings, from the plurality of circular openings;

wherein a portion of at least two of said plurality of circular grooves, extends to each opening from each of said six adjacent openings; and wherein each circular groove defines an outer radius, and the outer radius of each circular groove is selected such that more than six necks of material formed of the shell and forming part of the outer surface of said shell lie within the area of each circular groove, which necks are delimited by the adjacent openings and their corresponding circular grooves.

* * * * *

UNITED STATES PATENT AND TRADEMARK OFFICE

CERTIFICATE OF CORRECTION

PATENT NO. : 7,491,160 B2
APPLICATION NO. : 11/054120
DATED : February 17, 2009
INVENTOR(S) : Juhani Vestola et al.

It is certified that error appears in the above-identified patent and that said Letters Patent is hereby corrected as shown below:

In column 3, line 50 of the issued patent, "$s<r\leqq(s+d/2)$" should be --$s<r\leq(s+d/2)$--.

In column 4, line 7 of the issued patent, "others-are" should be --others are--.

In column 4, line 8 of the issued patent, "two-adjacent" should be --two adjacent--.

In column 4, line 41 of the issued patent, "1-25" should be --10-25--.

In column 5, lines 20-21 of the issued patent, "equilateral-triangle" should be --equilateral triangle--.

Signed and Sealed this

Thirty-first Day of March, 2009

JOHN DOLL
*Acting Director of the United States Patent and Trademark Office*